US005591408A

United States Patent [19]

Belgardt et al.

[11] Patent Number: 5,591,408

[45] Date of Patent: Jan. 7, 1997

[54] REPETITION PIPETTE

[75] Inventors: Herbert Belgardt; Klaus Schürbrock, both of Hamburg; Rolf-Günter Meyer, Bendestorf, all of Germany

[73] Assignee: Eppendorf-Netheler-Hinz GmbH, Hamburg, Germany

[21] Appl. No.: 419,334

[22] Filed: Apr. 10, 1995

[30] Foreign Application Priority Data

Apr. 27, 1994 [DE] Germany ..... 44 14 760.0

[51] Int. Cl.[6] ..... B01L 3/02

[52] U.S. Cl. ..... 422/100; 222/287; 222/309; 222/391; 73/864.16; 73/864.18

[58] Field of Search ..... 422/100; 222/287, 222/309, 309 OR, 287 OR, 391, 391 OR; 73/864.16, 864.18

[56] References Cited

U.S. PATENT DOCUMENTS

| | | | |
|---|---|---|---|
| 2,768,769 | 10/1956 | Cornell et al. | 222/80 |
| 4,041,764 | 8/1977 | Sabloewski et al. | 73/425.6 |
| 4,099,548 | 7/1978 | Storm et al. | 222/391 |
| 4,406,170 | 9/1983 | Kohn | 73/864.16 |
| 4,467,942 | 8/1984 | Oshikubo | 222/44 |
| 4,470,317 | 9/1984 | Sabloewski | 73/864.16 |
| 4,581,022 | 4/1986 | Leonard et al. | 222/391 |
| 5,323,931 | 7/1994 | Robards, Jr. et al. | 222/391 |
| 5,330,721 | 7/1994 | Tervamaki | 422/100 |

*Primary Examiner*—Jill Warden
*Assistant Examiner*—Sharidan Carrillo
*Attorney, Agent, or Firm*—Anderson Kill & Olick P.C.

[57] ABSTRACT

The invention relates to a repetition pipette including a syringe receiving section for a mounting portion of a syringe, said pipette comprising a receiving member having a piston receiving portion for the mounting portion of a syringe piston, piston returning means for moving said receiving member away from said syringe receiving portion, piston advancing means for advancing said receiving member towards said piston receiving portion in steps corresponding to the liquid volumes to be ejected by the syringe, and step width adjusting means for adjusting the width of the steps of said receiving member by means of an adjustment element, characterized by constant step means for setting the width of the first step to a constant value independent of adjustments of said adjustment element for the widths of following steps.

8 Claims, 9 Drawing Sheets

REPETITION PIPETTE

BACKGROUND OF THE INVENTION

The present invention relates to a repetition pipette as defined in the introductory portion of claim 1.

A repetition pipette of this type has become known from German patent 29 26 691. In this pipette the syringe receiving section is a U-shaped groove in a pipette housing into which a syringe flange can be inserted through a lateral housing opening. In the receiving section the syringe flange is biased by a compression spring towards the delivery opening. The syringe piston includes a cylindrical actuating portion adapted to be fixed in the receiving member by clamping means. The piston returning means comprises a lever of the receiving member which extends through a lateral housing slot. The piston can be moved out of the syringe by movements of the lever away from the syringe flange. The piston advancing means comprises rack pawl means, the rack being connected to the receiving member and the pawl being pivotally mounted to a reciprocable drive lever. When the drive lever is pivoted towards the syringe flange, the pawl is catched so as to drive the rack and the piston connected therewith in the same direction. When the pawl is pivoted in the opposite direction, the pawl disengages from the saw-tooth-shaped toothing so that the piston does not change its position. The step width adjusting means comprises a tongue coupled to a rotary knob which covers the toothing more or less depending on the position of the rotary knob. Adjusting the rotary knob allows to adjust also that portion of pawl movements along which the pawl engages the tooth so as to drive the piston. The volume of liquid dispensed by the syringe is adjustable by means of the rotary knob.

The syringe is received from its receiving means with a certain play. Furthermore the adjusting means operate with play. As a result the piston is moved in a first advancing step for another distance than in the following steps. Accordingly, the liquid volume dispensed at the first step differs substantially from the liquid volume dispensed in any following step. In practice the liquid dispensed in the first step is thrown away to provide for precise dosing. As a result probe liquid is lost. This may be overcome by providing for relatively small first step width and by adjusting the width to the required values for the succeeding steps. However, this requires cumbersome handling and may result in errors.

SUMMARY OF THE INVENTION

It is an object of the present invention to provide a repetition pipette which allows for precise dosing, with loss of probe liquid being minimal and handling being extremely simple.

The solution of this object according to the present invention has been defined in claim 1. Further developments of the invention have been defined in the dependent claims.

In the repetition pipette of the present invention there is provided constant step means which sets the width of the first step to a constant value after returning of the receiving member by means of said step width adjustment means independent of settings of the step width. In the first advancing step the piston dispenses constant liquid volumes independent of any adjustments of delivery volumes in the following steps. The width of the first step can be dimensioned such that the effects of play occuring when the direction of piston movements is reversed, are just safely overcome and that a minimal liquid volume is dispensed.

For example, the width of the first step may be 2 mm. The play compensation achieved in this manner provides for very precise liquid dosage in accordance with the adjusted step width in the following steps. Minimal liquid delivery in the first steps results in maximal liquid volumes for the remaining steps. This results in a maximal number of remaining steps, which depends on step width adjustments. Accordingly, a repetition pipette according to the invention allows for the first time for precise dosing and a maximum number of dosing steps without requiring any special handling operations by the user.

Preferably, the piston advancing means comprises a rack pawl means in accordance with German patent 29 26 691. A rod including tooth-shaped projections may be used as rack, along with a threaded rod or a rod having circumferential teeth. According to the above-mentioned publication the step width adjusting means may comprise a withholding element shaped for example as a tongue and displaceable along the rack, which withholding element restricts engagement of the pawl with the rack. In connection with these features the constant step means may include a further withholding element which is movable from a withholding position to a release position. When it is in the withholding position, it prevents engagement of the pawl, and when it is in the release position, it enables engagement of the pawl. Movements of the withholdung element are controlled by movements of the receiving member. When the receiving member is in the completely returned position, said further withholding element is controlled so as to be in the withholding position. Advancing of the receiving member controls the withholding element to be in the release position. When the piston advancing means is actuated after the actuating element has been returned, said further withholding element which is in the withholding position initially prevents engagement of the pawl with the rack. However, an abutment element connected to the receiving member extends into the range of movements of the pawl and/or the actuating element when the receiving member has been fully returned, and it is urged in the advancing direction by the actuating element and/or the pawl during the end portion of the first step. The abutment element drives the receiving member in the advancing direction so as to move said further withholding element to the release position. This enables engagement of the pawl with the rack for the remaining portion of the first step and/or further steps.

Preferably, said further withholding element is an L-shaped lever. A first leg of the lever is mounted so as to be pivotal and cooperates with an endwise support surface of the receiving member. The second leg includes said withholding surface of said withholding element. The receiving member when it is returned is urged against said first leg whereby said second leg is pivoted to the withholding position. When the receiving member has been fully returned, also the second leg prevents the pawl from engaging the rack. When the receiving member is advanced, its support surface releases the first leg and the second leg returns to the release position. This allows for engagement of the pawl for further advancements of the receiving member.

Preferably, the first leg is mounted adjacent its free end and the withholding surface is formed at an inner surface of the second leg. The pawl then may be positioned adjacent the inner side of the two legs at minimal space requirements. For positive control of said further withholding element, the first leg may be provided with a cam in spaced relationship to its pivotal mounting, which cam cooperates with a support surface of the receiving member.

The abutment element may be a projection of the rack which extends beyond said further withholding element in the withholding position. In the course of first actuation of the piston advancing means after returning movements, the pawl slides along the withholding element until it reaches said projection. During the end portion of its movements the pawl drives the projection and the receiving member connected thereto via the rack, with the receiving member moving said further withholding element to the release position.

The abutment element may be a pin projecting from the receiving member and extending into the range of movements of the actuating element. When the piston advancing means is initially actuated after having been returned, the pawl slides across said further withholding element, and the actuating element hits upon the pin. In the end range of its movements the actuating element biases the receiving member by means of the pin in the advancing direction whereby said further withholding element is moved to the release position and engagement of the pawl for further advancing movements is enabled. Preferably, the receiving member controls said further withholding element such that the pawl engages a certain tooth of the rack already during the first advancing step. Then the first step will result in a reproduceable start position of the syringe piston, and the number of possible dosages is known for any adjusted step width. To provide for engagement of the pawl with a certain tooth, a recess of the withholding element may be provided in the end range of movements of the pawl in the advancing direction. The actuating element when moved in the advancing direction initially hits upon the pin, and after further movements in the same direction the pawl engages with a tooth of the rack within the recess of the withholding element. Principally, a tooth released by said recess can be the only abutment element for advancing the receiving member.

When advancing of the receiving member is caused by engagement of the pawl with a tooth within the recess, the displaceable withholding element may prevent pawl engagement for settings of small step width. This is true in the case that a plurality of teeth will be in the recess to control movements of the receiving member along the complete constant step width. When the pawl does not succeed to engage within the recess, the actuating element may hit upon the pin and advance the receiving member at least to a position wherein the pawl engages with a tooth accessible adjacent the withholding element, in order to maintain the constant step width. This ensures to achieve a defined piston position for following dosing steps at arbitrary dosing amounts.

BRIEF DESCRIPTION OF THE DRAWINGS

Further details and advantages of the invention result from the following description of the accompanying drawings of preferred embodiments. In the drawings.

DETAILED DESCRIPTION OF THE PREFERRED EMBODIMENT

Figure 1:
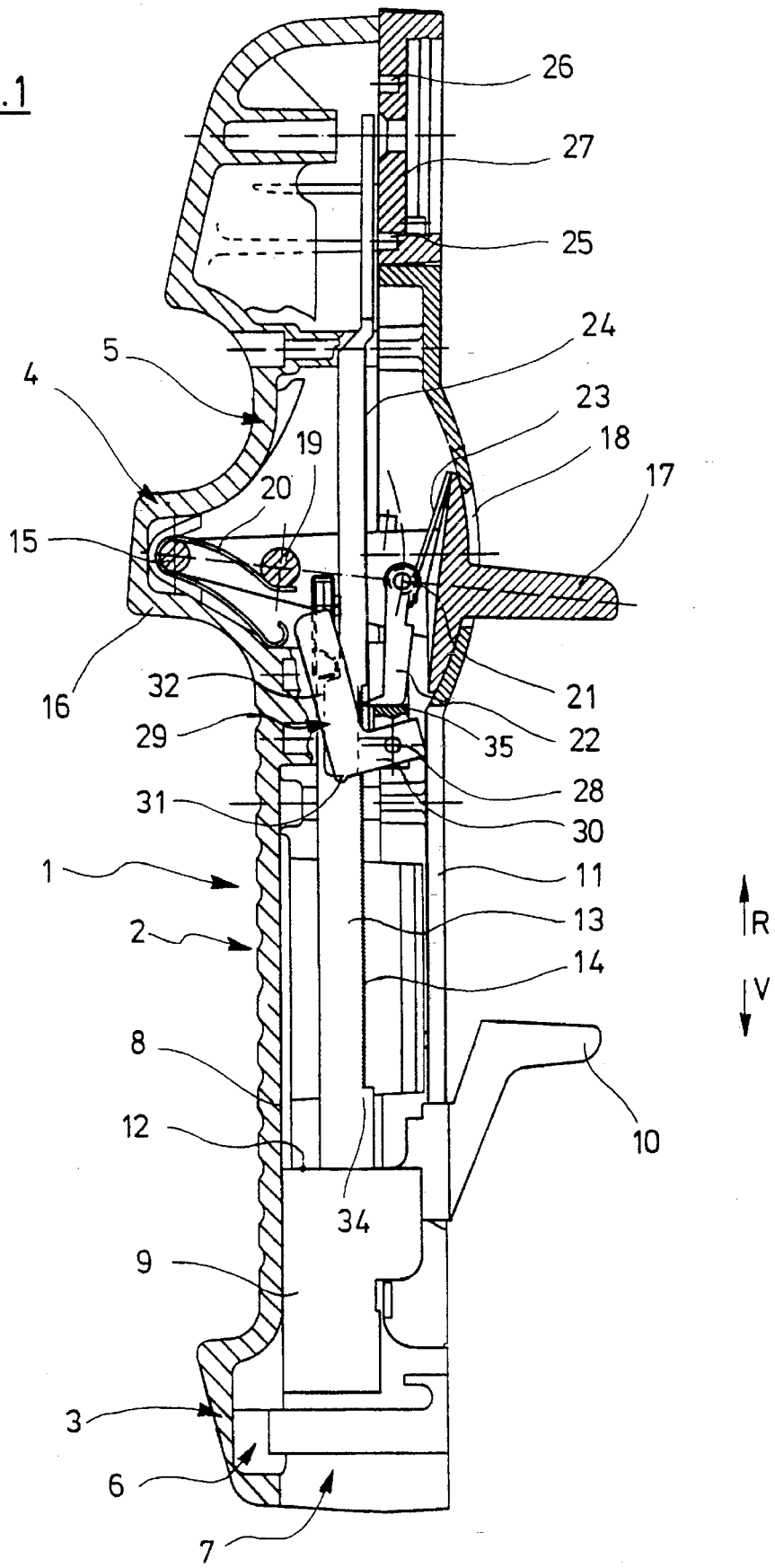
FIG. 1 shows a repetition pipette including a rack shoulder serving as abutment element of the constant step means at an adjustable piston advancing step, in a longitudinal section.

The repetition pipette as shown in FIG. 1 includes a housing 1 which comprises a middle portion 2 formed as a handle, a foot portion 3 and a head portion 4 with a finger engagement depression 5. In the foot portion 3 there is provided a syringe receiving section 6 for a syringe flange, which is formed as a groove of U-shaped section which is open towards the (in the drawing) right side of the housing 1. Furthermore the foot portion 3 is provided with a through-opening 7 for the syringe body.

The middle portion 2 includes a guide 8 slidingly receiving a receiving member 9 for the actuating end of the syringe piston. The receiving member 9 includes a—not shown—clamping device for fixing the inserted actuating end within the receiving member 9.

Furthermore the receiving member 9 includes a returning lever 10 extending from a slot 11 in the right side of the housing.

The receiving member 9 carries, at its plane face 12 remote from the receiving section 6, a rack 13 which extends through the middle portion 2 to the head portion 4 of the housing 1. The rack 13 has, at its right side, a saw-tooth-shaped toothing 14 the steeper flank of which faces the head portion 4.

Within the head portion 4 an actuating lever 17 is pivotally mounted on an axis 15 in a formation 16 of the left housing side, which actuating lever has an actuating end project from a slot 18 at the opposite housing side. Between a pin 19 of the actuating lever 17 and the inner wall of the housing there is provided a leg spring 20 which biases the actuating lever 17 towards the housing head 4.

To the right of the rack 13 a pawl 22 is pivotally mounted at the actuating lever 17 upon a further axis 21, which pawl has an engagement end engaged with the toothing 14 as shown in FIG. 1. The pawl 22 is biased towards the rack 13 by means of a further leg spring 23 supported upon the pawl and the actuating lever 17.

A withholding element comprising a tongue 24 is disposed within the head portion 4. The tongue 24 covers a portion of the toothing 14 and is displaceable along the latter. To this end it includes, adjacent its end facing away from the rack 13, a pin 25 which engages an arcuate guide 26 of a rotary knob 27 mounted within the head portion 4 of the housing. The position of the tongue 24 in the housing and the extent for which it covers the toothing 14 can be changed by adjustments of the rotary knob 27.

The above-mentioned components are provided in all shown embodiments. Insofar they are similar to the embodiment of German patent 29 26 691 the disclosure of which is incorporated herein by reference. In the following the differential features of the various embodiments will be explained:

As shown in FIG. 1 an L-shaped lever 29 has a first leg 30 pivotally mounted on a stationary axis 28. The first leg 30 includes a cam 31 at its end remote from its mounting at its side facing the receiving member 9. A second leg 32 has a withholding surface 33 at its side facing the pawl 22. The pawl 22 is disposed adjacent the inner side of the two legs 30, 32. A spring supported against the housing is adapted to bias the lever 29 counter-clockwise. Furthermore, the rack 13 is provided at its end adjacent the receiving member with a shoulder 34 which extends beyond the toothing 14. This repetition pipette is operated as follows:

A syringe has its flange inserted into the syringe receiving section 6, its body into the through-opening 7 and its actuating end into the receiving member 9. Within the receiving section 6 it is biased by a—not shown—leaf spring towards its delivery end and is clamped within the receiving member 9. The syringe may be used either loaded or unloaded, with its piston being completely projected or retracted. Before it is inserted when it is in its loaded condition, the receiving member 9 is returned by means of the returning lever 10 in the direction R. A syringe which is inserted in the unloaded condition can draw liquid when the returning lever 10 is retracted.

Figure 2:
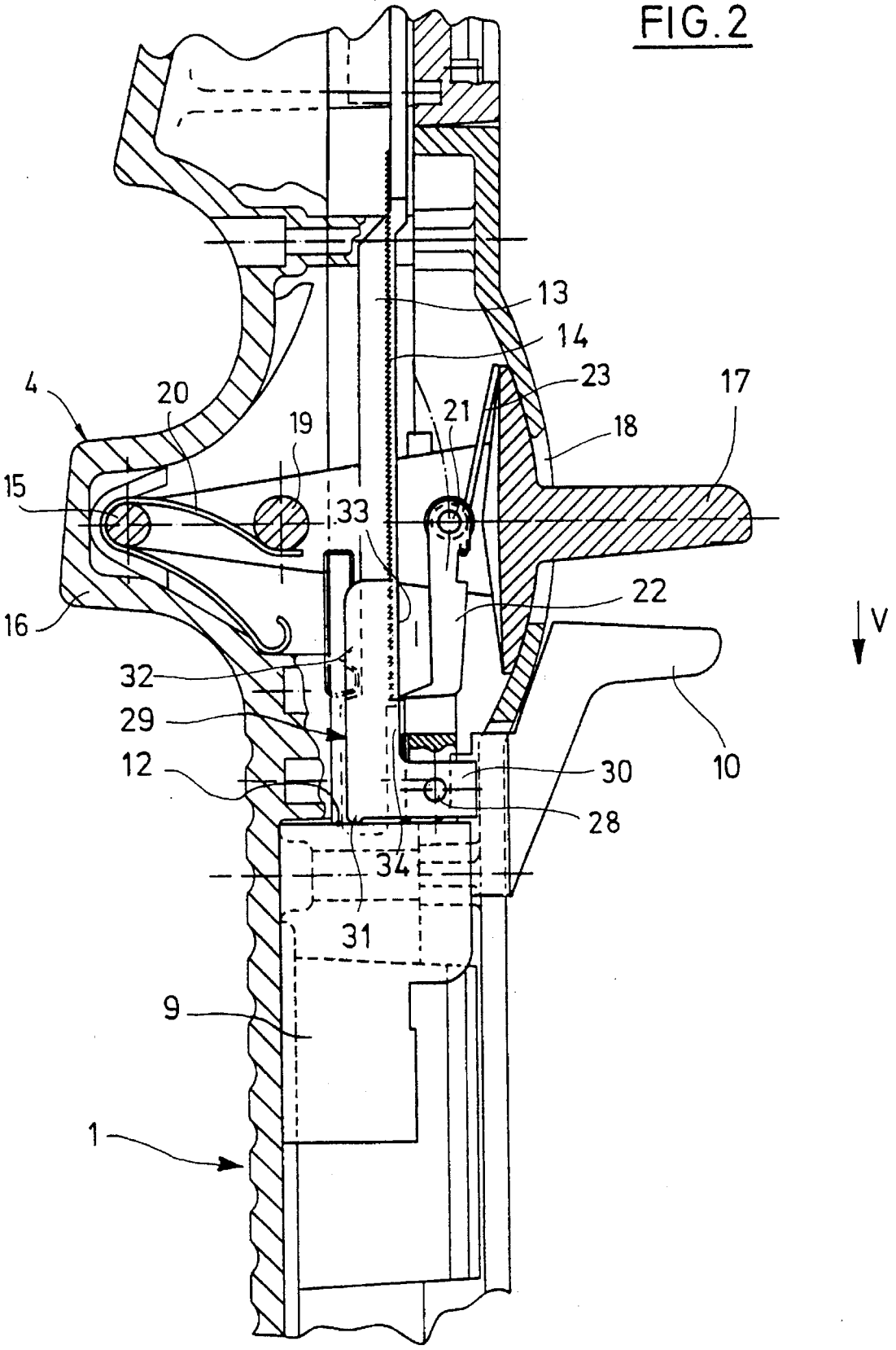
FIG. 2 shows the same repetition pipette during a constant advancing step in a partial section including the constant step means.

When the receiving member 9 has been completely retracted and accordingly the piston has been withdrawn from the syringe, the repetition pipette is ready for liquid delivery. FIG. 2 shows the receiving member 9 in this position wherein its face 12 serving as a support surface is urged against the cam 31 of the lever 29. As a result, the lever 29 is slightly pivoted clockwise so that its second leg 32 is parallel to the rack 13 and its withholding surface 33 extends beyond the toothing 14 at the right side. Upon initial clockwise actuation the actuating arm 17 causes the pawl 22 with its actuating end to move along the withholding surface 33 without resulting in engagement of the pawl with the toothing 14. As a result the receiving member 9 and the syringe piston are not displaced in the direction V. In the position shown in FIG. 2 the pawl 22 has reached the shoulder 34.

Figure 3:
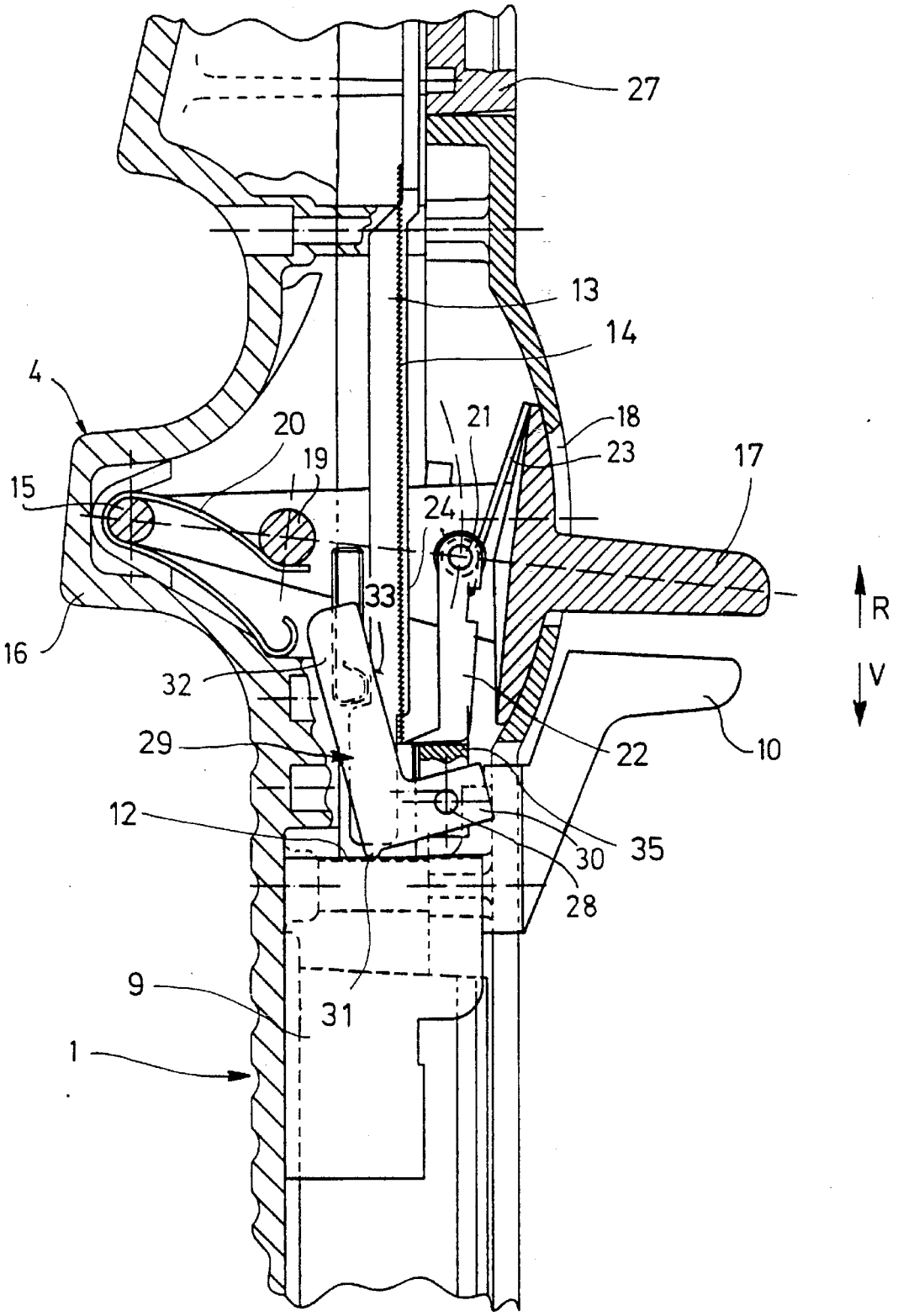
FIG. 3 shows the same repetition pipette at the end of the constant advancing step in the same partial section.

Upon continued advancement of the pawl 22 by pivotal movements of the actuating lever 17 the shoulder 34 is moved in the advancing direction V. As shown in FIG. 3 the receiving member 9 is also advanced in the direction V. The lever 29 has its cam 31 follow the support surface 12 because it is pivoted counter-clockwise by spring biased lever 22 or an own spring. As a result the withholding surface 33 releases the toothing 14 of the rack 13. The first advancing step is terminated when the pawl 22 engages a stationary abutment 35.

Thereafter, the actuating lever 17 is pivoted back in the returning direction R by its spring 20. Upon following lever actuations the pawl 22 engages the toothing 14 as soon as it has reached toothing areas released by spring 24, and displaces the rack 13 in the direction V. The dispensed liquid volumes accordingly depend only on the setings of the rotary knob 27 in the succeeding steps. FIG. 1 shows one of the last dosing steps.

Figure 4:
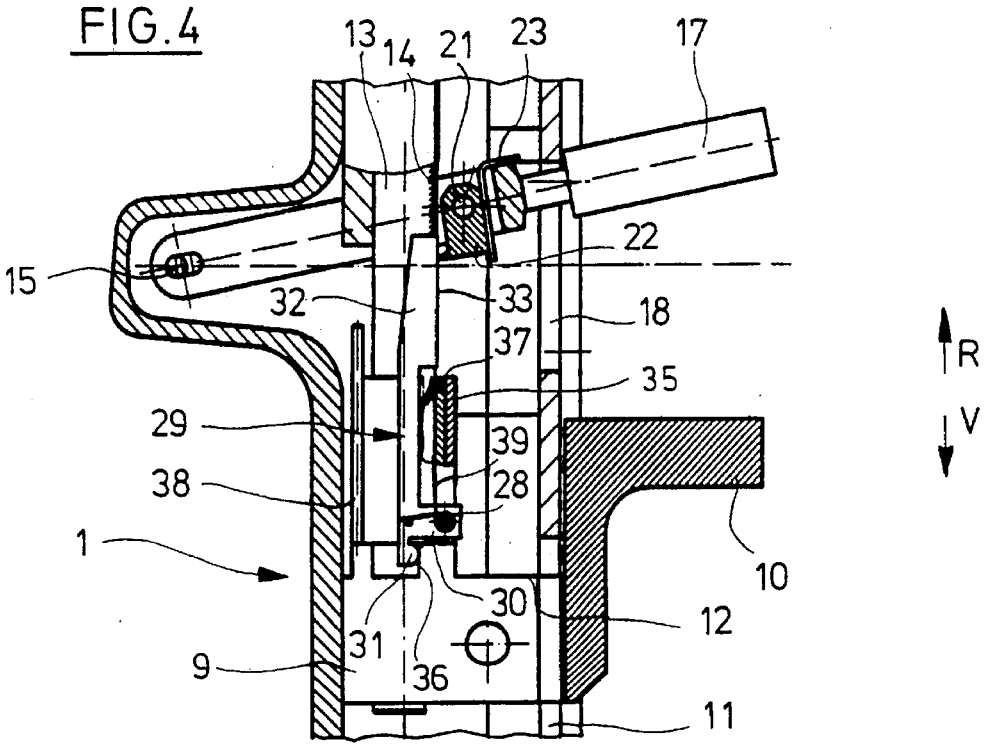
FIGS. 4 to 7: a repetition pipette including an abutment pin and a lever recess of the constant step means at the beginning (FIG. 4), when the pin is engaged (FIG. 5) when the pawl is engaged (FIG. 6) and at the end of a constant advancing step (FIG. 7) in a partial section including the constant step means.

Also in the embodiment of FIGS. 4 to 7 there is provided an L-shaped lever 29 which has a first leg 30 mounted on a stationary axis 28 on the right side of the rack 13. The first leg 30 carries a cam 31 which is parallel thereto and spaced from the axis 28; as shown in FIG. 4 the cam engages a projection 36 of face 12 of receiving member 9 which is parallel to rack 13.

The first leg 32 of the lever 29 has, adjacent to the first leg 30, a recess 37 extending along about half its length. Adjacent thereto, the leg 32 has a withholding surface 33 facing the pawl 22. The lever 29 is acted upon counter-clockwise by the pawl 22 and a leg spring 39 supported against the housing 1.

The receiving member 9 carries a pin 38 which extends into the range of movements of the actuating lever 17. This repetition pipette operates as follows:

Initially the receiving member 9 is moved in the returning direction R by means of the returning lever 10 to the position shown in FIG. 4. The support surface of the projection 36 urges against the cam 31 and pivots the lever 29 clockwise to the shown position wherein the withholding surface 33 extends beyond the toothing 14. When thereafter the actuating lever 17 is actuated in the advancing direction V, the pawl 22 slides across the withholding surface 33 and is prevented by the latter from engaging the toothing 14.

Figure 5:
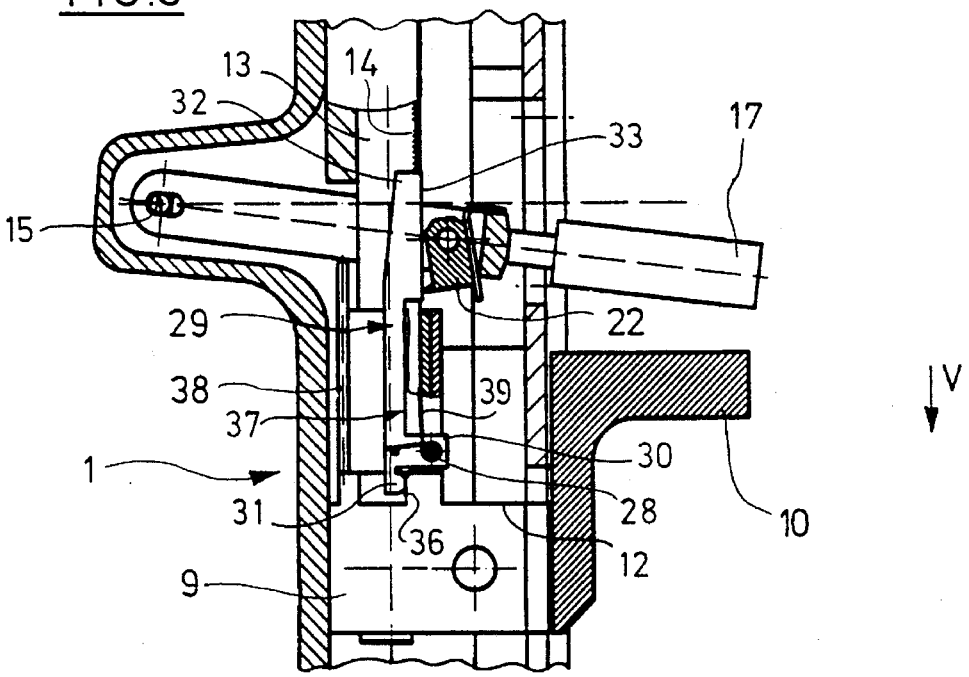

As shown in FIG. 5, the actuating lever 17 reaches the pin 38 in the course of its first actuation. The pawl 22 does not yet engage the toothing 14.

Figure 6:
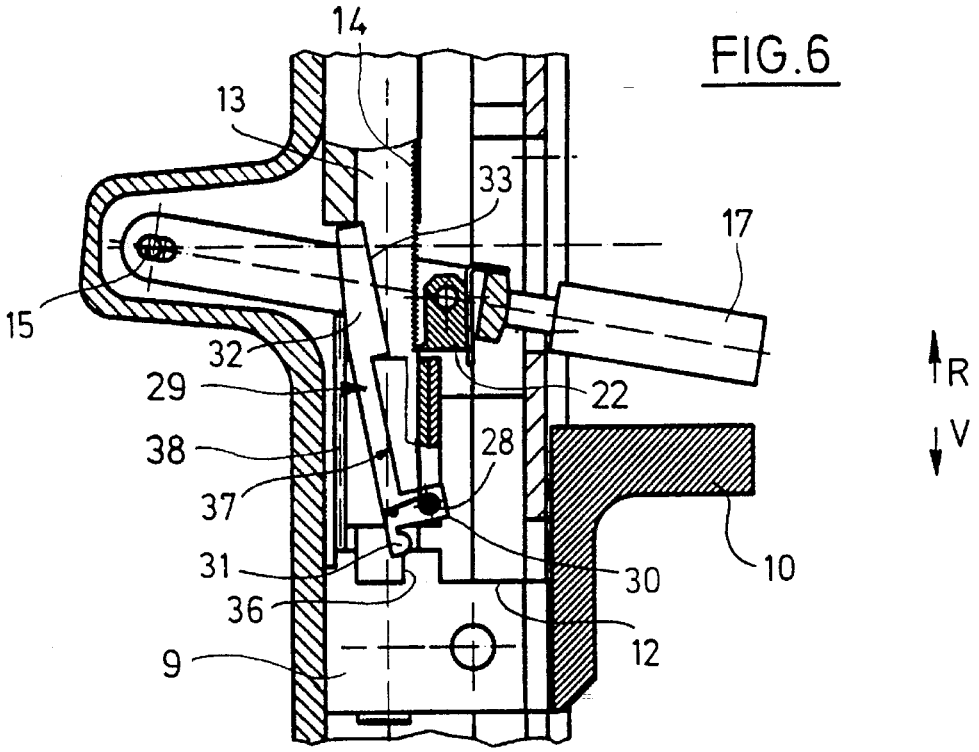

In FIG. 6 it is shown that the actuating lever 17 advances the pin 38 and the receiving member 9 upon further actuation in the advancing direction V. The spring-biased lever 29 is pivoted back counter-clockwise and releases the toothing 14. The pawl 22 precisely engages the first tooth of the toothing 14.

Figure 7:
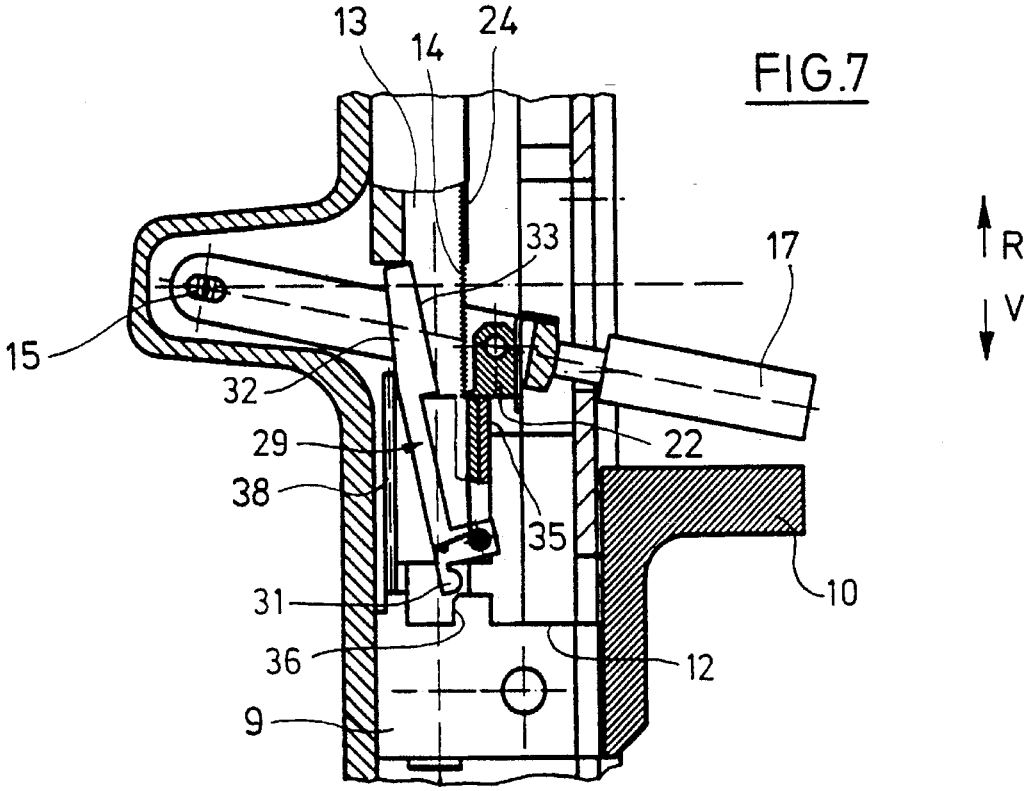

The FIG. 7 shows that—as a result thereof—the rack 13 and the receiving member 9 connected thereto are advanced precisely to a position determined by engagement of the pawl 22 with the stationary abutment 35. The pawl 22 is guided about the axis 15 along a greater circular arc than the contact area of the actuating lever 17 acting upon the pin 38. As a result, the actuating lever 17 at the end of its first actuation does not longer engage the pin 38, and the advancing movement of the receiving member 9 is determined exclusively by pawl engagement.

For a following dosing operation the actuating lever 17 is pivoted back counter-clockwise. During following actuation of the lever, the pawl 22 is initially prevented from engaging the toothing by the tongue 24. As soon as it has reached the freely accessible portion of the toothing 14, it comes into engagement and advances the rack 13 in the direction V. The dispensed amounts of liquid, accordingly, depend only from the settings of the tongue 24.

Figure 8:
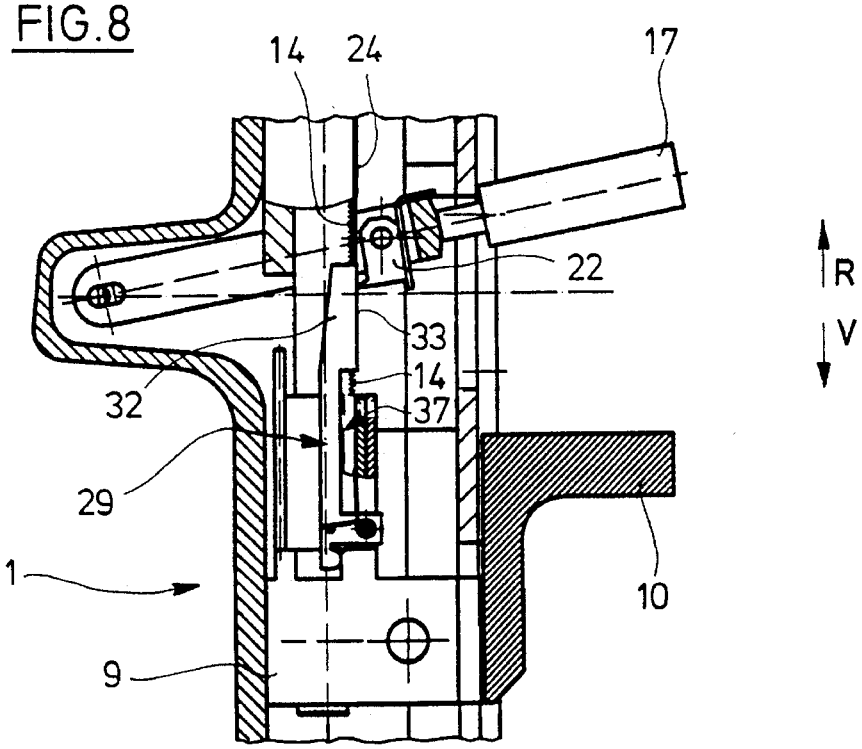
FIGS. 8 to 10: a repetition pipette having an increased step width setting at the beginning (FIG. 8), when the pin and the pawl are engaged (FIG. 9) and at the end of a constant advancing step (FIG. 10) in a partial section including the constant step means.
Figure 9:
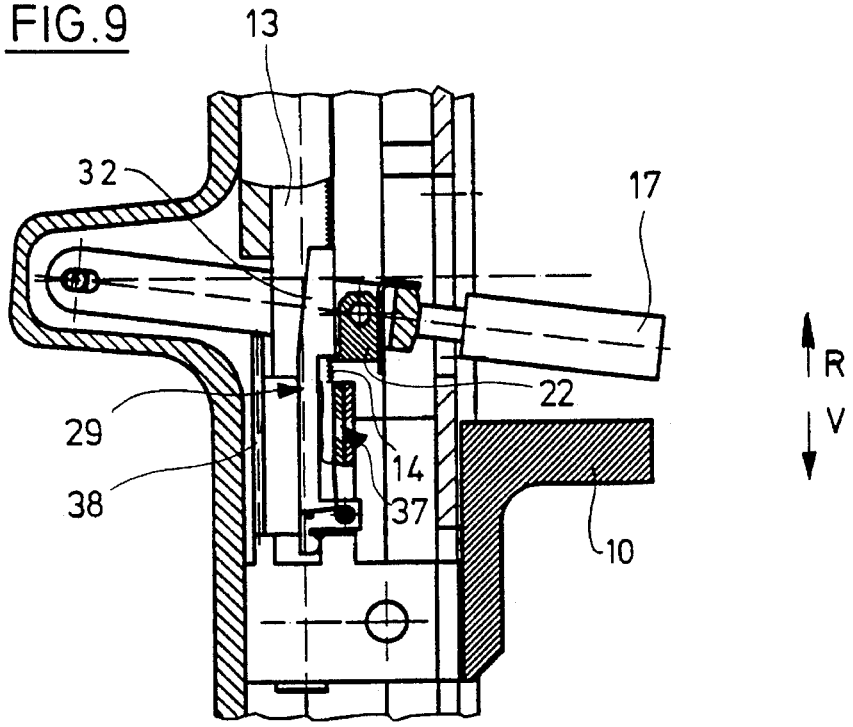
Figure 10:
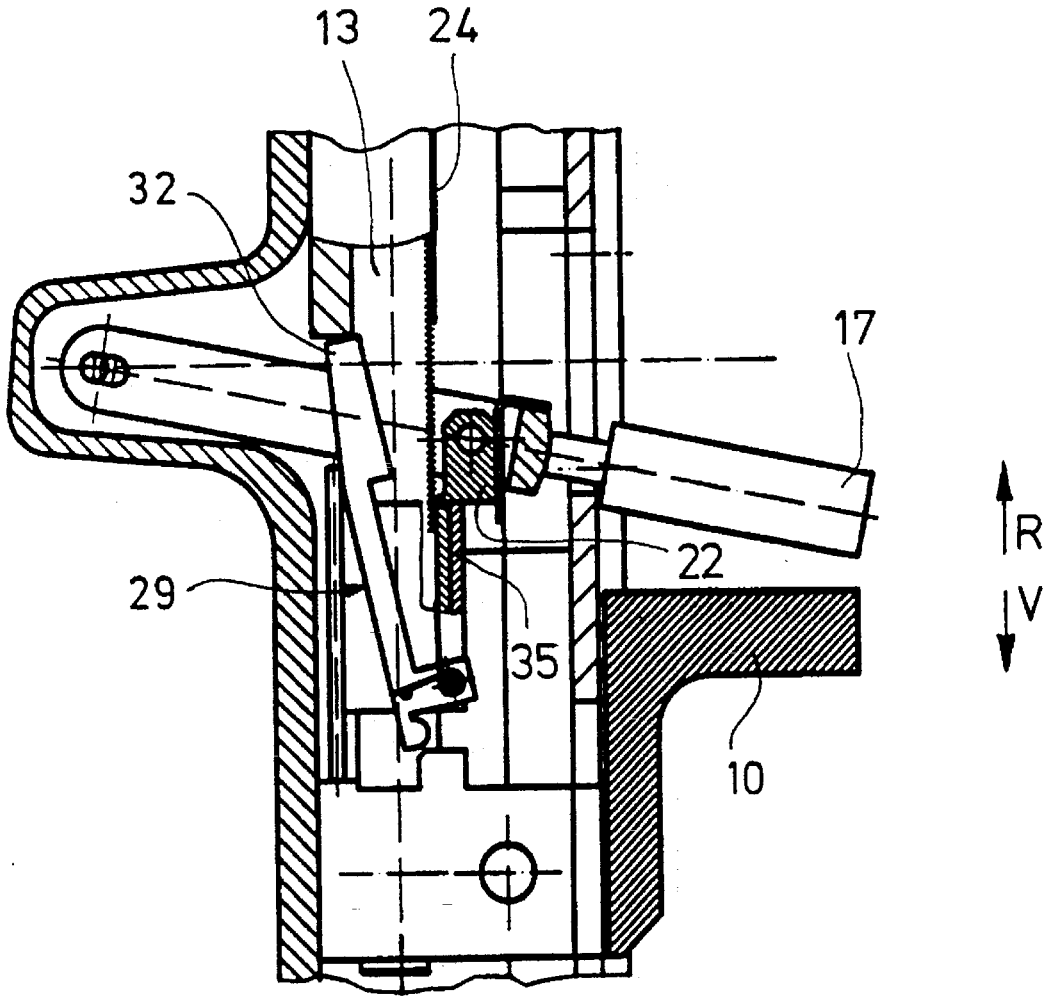

The embodiment of FIGS. 8 to 14 has, in contrast to the embodiment of FIG. 4, a recess 37 which extends further towards the second leg 32 of the lever 29. The recess 37 releases four teeth of the toothing 14 adjacent to the withholding surface 33. This embodiment operates as follows:

First, with reference to FIGS. 8 to 10, an application is considered wherein relatively large dosage volumes are set. The tongue 24 releases a substantial portion of the toothing 14 for engagement by the pawl 22.

The FIG. 8 shows the pipette prior to its first actuation, with the receiving member 9 being completely returned in the direction R. When the actuating lever 17 is pivoted clockwise, the pawl 22 initially is prevented from toothing engagement by the withholding surface 33. When it reaches the pivoting position shown in FIG. 9, it engages the toothing 14 within the recess 37. At the same time, the pin 38 comes into engagement with the actuating lever 17. In this embodiment there are at most four teeth which are freely accessible within the recess 37. With a tooth spacing of 0.5 mm, a constant step width of 2 mm will be achieved.

When the actuating lever 17 is pivoted further, the pawl 22 drives the rack 13 in the advancing direction V. The spring biased lever 29 is pivoted counter-clockwise away from the toothing 14. The first advancing step is terminated in the position shown in FIG. 10 when the pawl 22 engages the stationary abutment 35.

After the actuating lever 17 has been pivoted counter-clockwise dosing operations can be performed, with the position of the withholding tongue 24 being effective to provide for relatively early pawl engangement and large dosage volumes.

Figure 11:
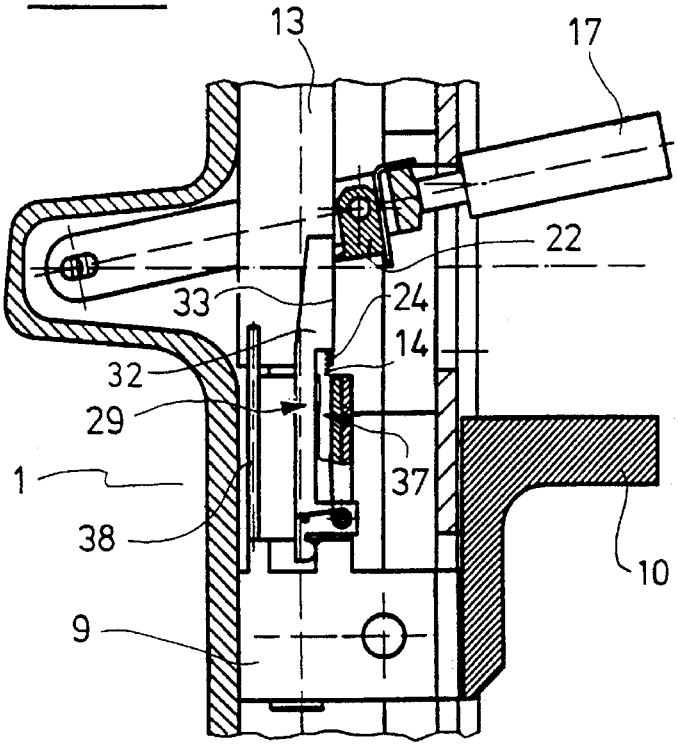
FIGS. 11 to 14 show the same repetition pipette at a decreased step width setting at the beginning (FIG. 11), when the pin is engaged (FIG. 12), when the pawl is engaged (FIG. 13) and at the end of a constant advancing step (FIG. 14) in the same partial section.
Figure 12:
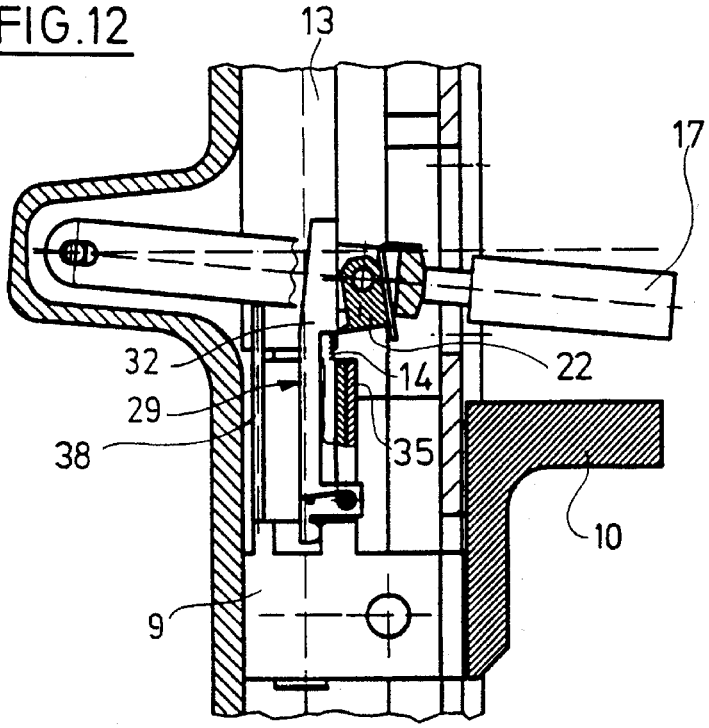

The FIGS. 11 to 14 show the same pipette suited for very small dosages, with the tongue 24 being advanced across the toothing 14 to a substantial extent. When the receiving member 9 has been completely returned as shown in FIG. 11, the tongue 24 within the recess 37 of the lever 29 releases just one tooth. As a result the pawl 22 is prevented from toothing engagement initially by the withholding surface 33 and thereafter by the tongue 24. According to FIG. 12 the actuating lever 17 has already reached the pin 38 and drives the rack 13 in the advancing direction V.

Figure 13:
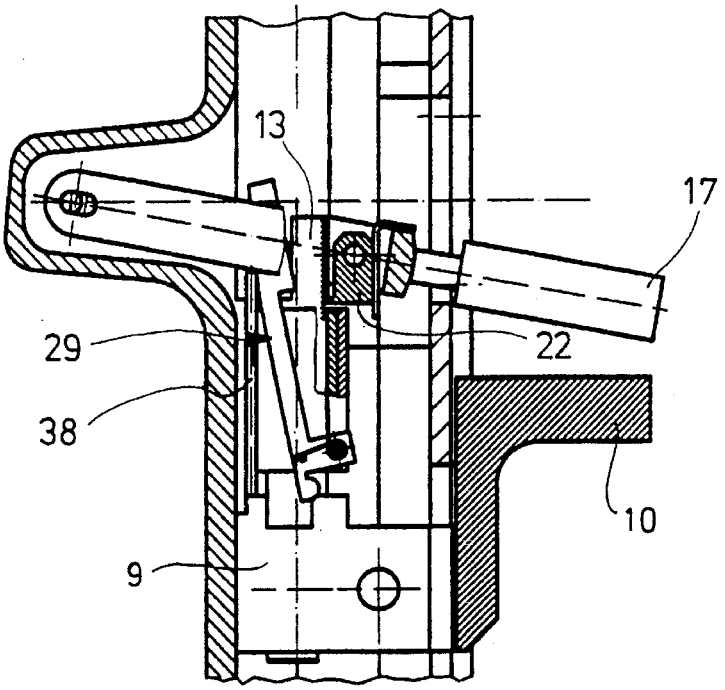
Figure 14:
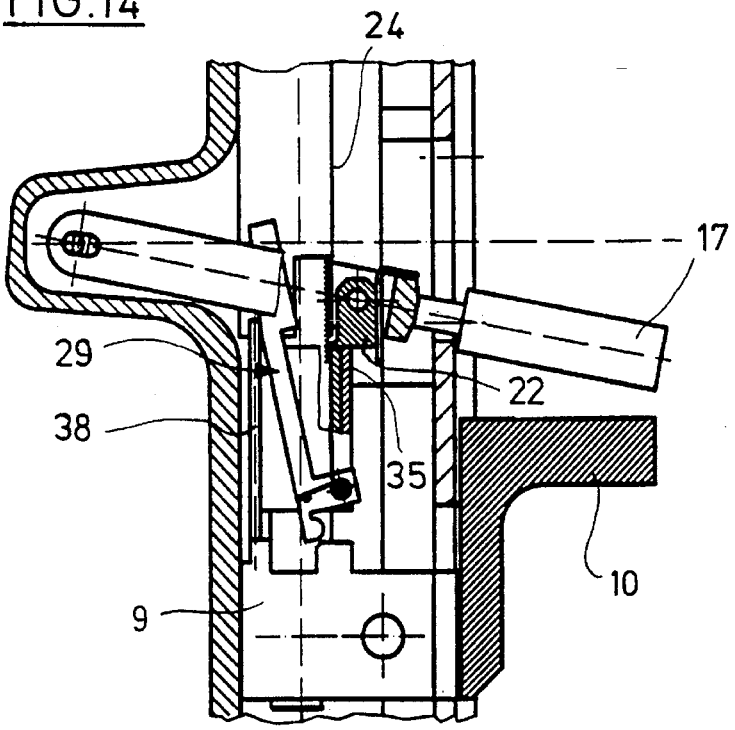

As shown in FIG. 13 the pawl 22 eventually engages the last tooth and advances the rack 13. The first actuating step is terminated when the pawl 22 hits upon the abutment 35 as shown in FIG. 14. Prior thereto the actuating lever 17 has been released from the pin 38.

As a result of displacement of receiving member 9 the lever 29 has been pivoted counter-clockwise also in this case. For the following dosing operations the tongue 24 allows for depensing of only small liquid amounts according to the advancing stroke of one tooth each.

We claim:

1. A repetition pipette including a syringe receiving section (6) for a mounting portion of a syringe, said pipette comprising a receiving member (9) having a piston receiving portion for the mounting portion of a syringe piston, piston returning means (10) for moving said receiving member away from said piston receiving portion, piston advancing means (13,17,22) for advancing said receiving member towards said piston receiving portion in steps corresponding to the liquid volumes to be ejected by the syringe, step width adjusting means (24) for adjusting the width of the steps of said receiving member by means of an adjustment element (27), constant step means (29) for setting the width of the first step to a constant value independent of adjustments of said adjustment element (27) for the widths of following steps;

wherein said piston advancing means comprises a rack (13) connected to said receiving member (9) and a pawl (22) pivotally mounted to an actuating element (17), said pawl being adapted to engage the toothing (14) of the rack upon movements of the actuating element in the advancing direction (V) so as to drive the rack and to disengage from the rack upon movements of the actuating element in the returning direction (R), and said step width adjusting means comprises a first withholding element (24) displaceable along the rack (13) by said adjustment element (27) for restricting engagement of the pawl (22) with said toothing, and wherein said constant step means includes a second withholding element (29) adapted to be displaced between a withholding position for preventing said pawl (22) from engagement with said rack (13) and a release position enabling engagement of said pawl, with the movements of said second withholding element to said withholding position being controlled by returning movements of the receiving member (9) and the movements of said second withholding element to said release position being controlled by advancing movements of said receiving member (9), and the receiving member (9) being connected to an abutment element (34,38) said abutment element extends into the range of movements of at least one of said pawl (22) and said actuating element (17) when said receiving member (9) has been completely returned, and the receiving member is urged in the advancing direction (V) by at least one of said actuating element and said pawl in the end range of the movements of said actuating element so as to drive said receiving member said second withholding element is a lever (29) having a first leg which is pivotally mounted and a second leg (32) which includes a withholding surface (33) for said pawl (22), and said receiving member (9) includes a support surface (12, 36) adapted to be urged against said first leg (30) during returning movements and to pivot said lever (29) with said second leg (32) to said withholding position.

2. A pipette according to claim 1, wherein said first leg (30) is pivotally mounted adjacent its free end and said withholding surface (33) is formed at an inner surface of said second leg (32).

3. A pipette according to claim 2, wherein said first leg (30) includes a cam (31) in spaced relationship to its pivotal mounting (28) for engagement with a support surface (12, 36) of the receiving member (9).

4. A pipette according to claim 1, wherein said abutment element comprises a projection (34) of said rack (13) which extends beyond said second withholding element (29) in the withholding position.

5. A pipette according to claim 1, wherein said abutment element comprises a pin (38) projecting from said receiving member (9) and extending into the range of movements of said actuating element (17).

6. A pipette according to claim 1, wherein said second withholding element (29) includes a recess (37) in the end range of movements of said pawl (22) for enabling engagement of said pawl with said toothing (14).

7. A pipette according to claim 6, wherein said actuating element (17) is adapted to engage a pin (38) upon movements in the advancing direction (V) and said pawl (22) is adapted to engage said toothing (14) within said recess (37) of said second withholding element (29) upon further movements of said pawl in the same direction.

8. A pipette according to claim 6, wherein said second withholding element (29) includes a recess (37) enabling engagement of said pawl with a plurality of teeth of said toothing (14), engagement of said pawl with the first tooth as seen in the advancing direction (V) causing advancement of said receiving member (9) for a constant width, and said actuating element (17) abutting said pin (38) when said first withholding element (24) prevents engagement of said pawl, and advancing said receiving member (9) to a position wherein said pawl engages a tooth adjacent said first withholding element.

* * * * *